US008910808B2

(12) United States Patent
Halford et al.

(10) Patent No.: US 8,910,808 B2
(45) Date of Patent: Dec. 16, 2014

(54) COUPLER KNUCKLE

(71) Applicant: Amsted Rail Company, Inc., Chicago, IL (US)

(72) Inventors: Joseph Halford, St. Louis, MO (US); Matthew Todt, Highland, IL (US); Timothy Dumey, Troy, IL (US)

(73) Assignee: Amstead Rail Company, Inc., Chicago, IL (US)

( * ) Notice: Subject to any disclaimer, the term of this patent is extended or adjusted under 35 U.S.C. 154(b) by 186 days.

(21) Appl. No.: 13/661,721

(22) Filed: Oct. 26, 2012

(65) Prior Publication Data

US 2014/0116976 A1 May 1, 2014

(51) Int. Cl.
*B61G 3/00* (2006.01)

(52) U.S. Cl.
USPC ..... 213/155

(58) Field of Classification Search
USPC ..... 213/152, 155, 156
See application file for complete search history.

(56) References Cited

U.S. PATENT DOCUMENTS

| | | | | |
|---|---|---|---|---|
| 4,605,133 | A | 8/1986 | Altherr | |
| 4,645,085 | A | 2/1987 | Hanula et al. | |
| 4,976,363 | A | 12/1990 | Altherr | |
| 5,145,076 | A * | 9/1992 | Murphy et al. | 213/155 |
| 5,582,307 | A | 12/1996 | Hawthorne | |
| 5,736,088 | A | 4/1998 | Burke | |
| 6,062,406 | A | 5/2000 | Duncan | |
| 6,129,227 | A | 10/2000 | Openchowski | |
| 6,488,163 | B1 | 12/2002 | Wurzer et al. | |

* cited by examiner

*Primary Examiner* — R. J. McCarry, Jr.
(74) *Attorney, Agent, or Firm* — Edward J. Brosius

(57) ABSTRACT

An improved coupler-knuckle assembly is comprised of a coupler body, a knuckle, and at least two knuckle retainer plugs. The knuckle has an internal coring geometry that increases the cross-sectional area of the throat portion of the knuckle compared to previous designs. The present invention's knuckle design includes a top and a bottom tapered holes in the knuckle with a locking groove at the bottom of each tapered hole for the knuckle retainer plugs to snap into. The knuckle retainer plugs are inserted through the coupler body and into the tapered holes in the knuckle. The improved coupler-knuckle assembly of the present invention reduces fatigue on the coupler, knuckle, and knuckle pin, prevents misalignment of the coupler-knuckle assembly, and prevents knuckle pin breakage.

8 Claims, 4 Drawing Sheets

COUPLER KNUCKLE

BACKGROUND OF THE INVENTION

The invention relates generally to railway car coupling systems, and more particularly to an improved cast metal coupler-knuckle assembly.

This invention is applicable to Association of American Railroads (AAR) Type E, F, and H couplers. In a standard railway coupler-knuckle assembly, a knuckle pin pivotally connects a coupler body and a knuckle. Both the coupler body and the knuckle have a pinhole that allows a single knuckle pin to pivotally secure the coupler and the knuckle together.

In the coupler-knuckle assembly design that is currently used in the railway industry, the knuckle's weakest section is in the throat area around the hole for the knuckle pin. The hole is $1\frac{21}{32}$ inches in diameter and goes completely through the coupler and the knuckle. The pinhole reduces the cross-section area of the knuckle's throat area, which is a highly stressed location in the coupler-knuckle assembly. Because of this weakness in the throat area of the knuckle, the current AAR cast metal coupler-knuckle assembly design does not consistently meet the AAR's newly adopted M-216 fatigue test for a coupler-knuckle assembly.

The current single style knuckle pin designs are either metallic or non-metallic. When in use, the knuckle pin can get loaded due to the misalignment of the pulling lugs and pinholes located both on the coupler body and the knuckle. The misalignment causes both the knuckle pin and the coupler-knuckle assembly to fatigue during use, and can cause damage or break the pin or assembly.

The present invention provides an improved railway coupler-knuckle assembly that strengthens the coupler-knuckle assembly and reduces fatigue on all components of the coupler-knuckle assembly.

SUMMARY OF THE INVENTION

In accordance with the present invention, an improved railway car metal cast coupler-knuckle assembly secured by two knuckle plugs instead of a single knuckle pin is provided for use.

The coupler-knuckle assembly is comprised of a coupler body, a knuckle, and at least two knuckle retainer plugs. The knuckle has an internal coring geometry that removes the knuckle pinhole that protrudes entirely through the knuckle in previous knuckle designs. The present invention's knuckle design includes a top tapered hole and a bottom tapered hole in the knuckle with a locking groove at the bottom of each tapered hole for the knuckle retainer plugs to snap into.

The knuckle retainer plugs have a top end and a bottom end, with a head on the top end, and a taper on the bottom end. On the tapered bottom end are locking tabs that snap into the locking groove at the bottom of the tapered hole in the knuckle, ensuring the knuckle is securely attached to the coupler body. The knuckle retainer plugs have relief cutouts on the head of the plugs to allow easy removal from the coupler-knuckle assembly.

It is an object of the present invention to provide a coupler-knuckle assembly with a greater cross-sectional area in the knuckle that is stronger through the knuckle throat area and consistently passes the AAR M-216 fatigue test.

It is another object of the present invention to provide a coupler-knuckle assembly with a knuckle that couples with a standard E, F, or H-type coupler, It is another object of the present invention to provide a coupler-knuckle assembly utilizing a multi-knuckle plug design wherein the plugs are independent of each other allowing for uniform alignment of the top and bottom pulling lugs, thus, reducing fatigue on both the coupler-knuckle assembly and knuckle plugs.

It is another object of the present invention to provide a coupler-knuckle assembly utilizing a multi-knuckle plug design that eliminates knuckle pin loading and prevents bending and breakage of the knuckle pin.

It is a further object of the present invention to provide a coupler-knuckle assembly utilizing a multi-knuckle plug design that allows the knuckle plugs to remain unloaded and the coupler and knuckle pulling lugs to remain uniformly aligned during use.

It is still a further object of the present invention to provide a multi-knuckle plug coupler-knuckle assembly that can be used in current OEM coupler production or for field replacement when knuckles need to be replaced in a current revenue service.

DETAILED DESCRIPTION

Figure 1:
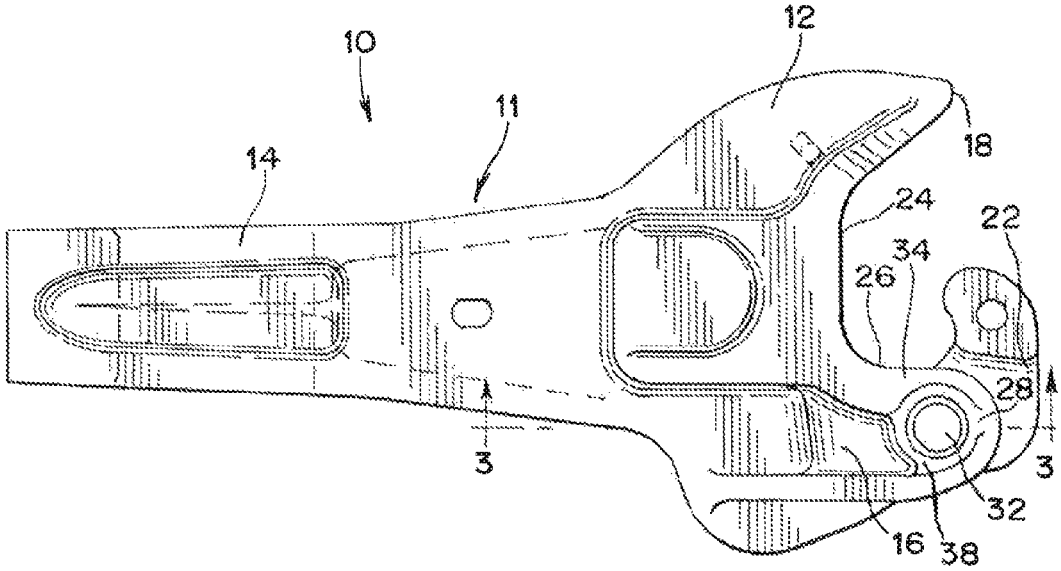
FIG. 1 PRIOR ART
FIG. 1 is a top plan view of a standard E-type coupler-knuckle assembly known in the prior art.
Figure 2:
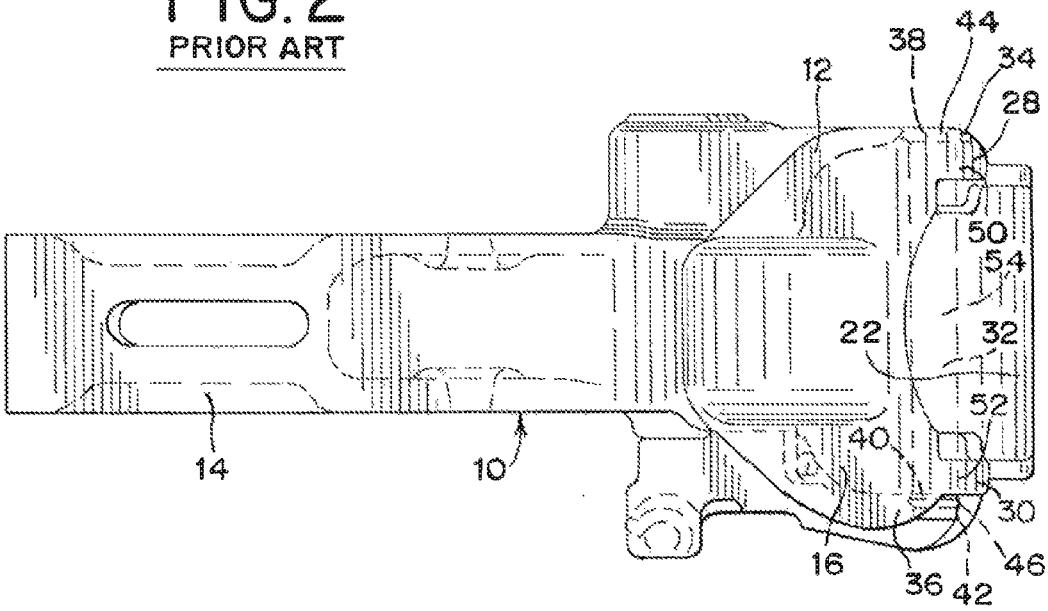
FIG. 2 PRIOR ART
FIG. 2 is a side elevational view of a standard coupler-knuckle assembly known in the prior art.
Figure 3:
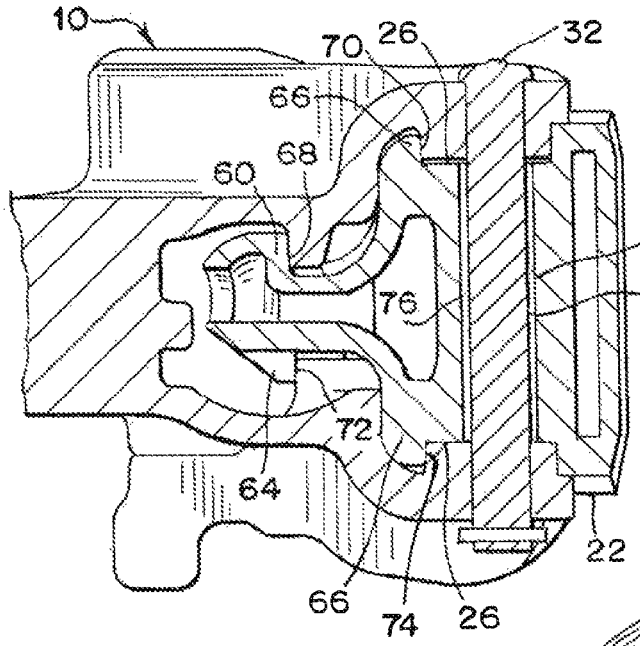
PRIOR ART FIG.3
FIG. 3 is a sectional view of a standard coupler-knuckle assembly known in the prior art along lines 3-3 of FIG. 1.
Figure 4:
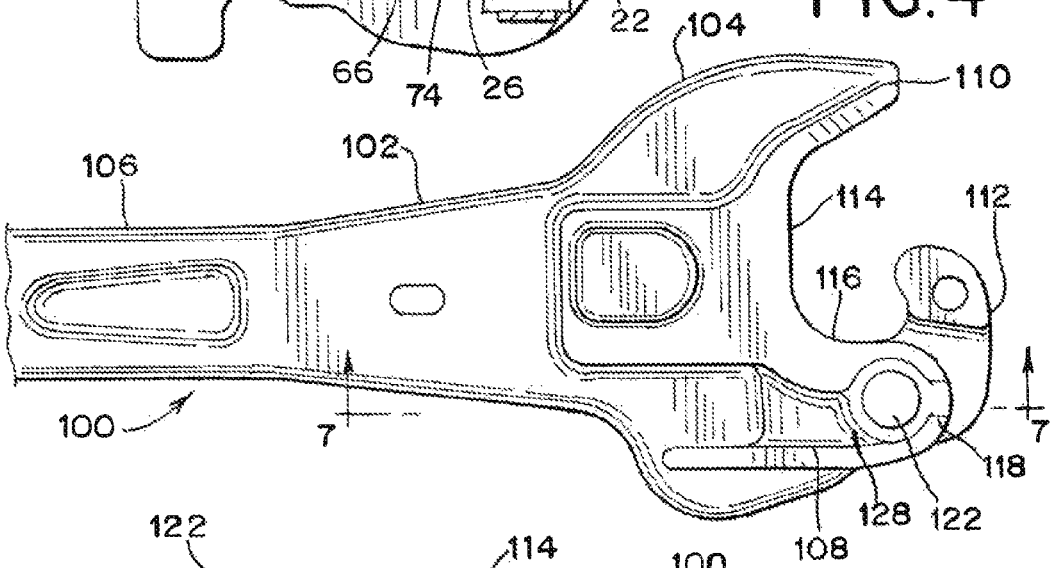
FIG. 4 is top plan view of the coupler-knuckle assembly of the present invention.
Figure 5:
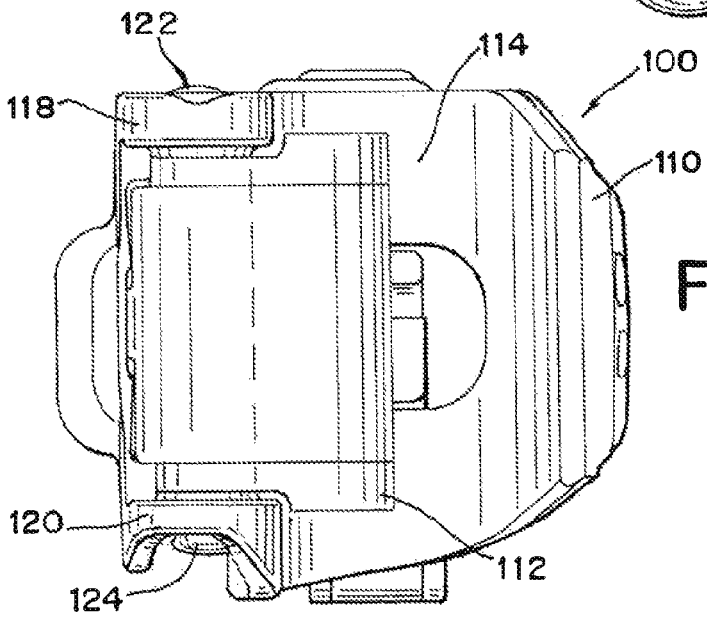
FIG. 5 is an end elevational view of the coupler-knuckle assembly of the present invention.
Figure 6:
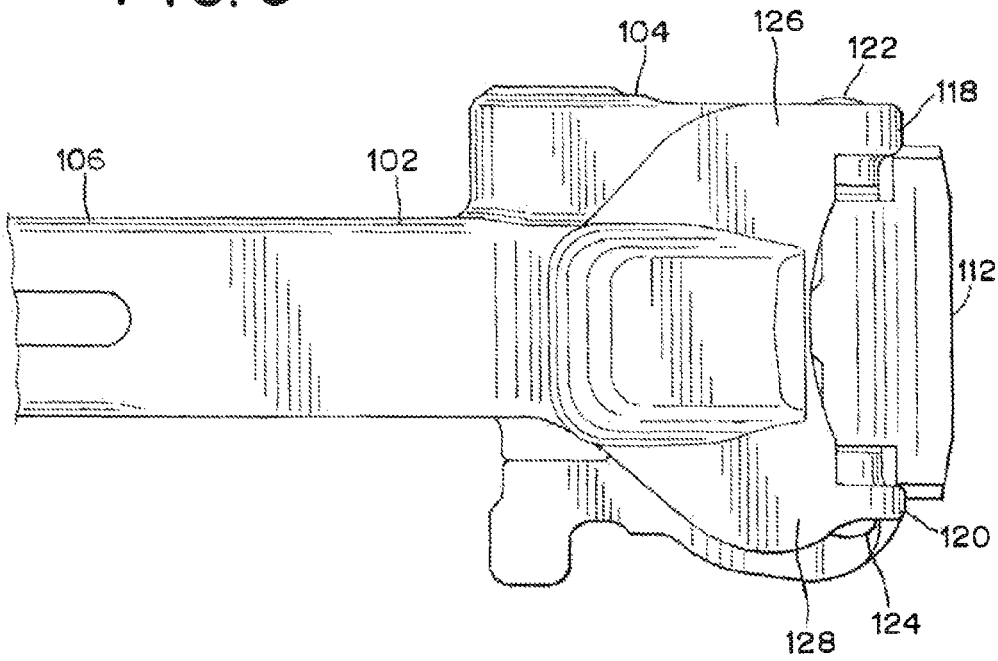
FIG. 6 is a side elevational view of the coupler-knuckle assembly of the present invention.
Figure 7:
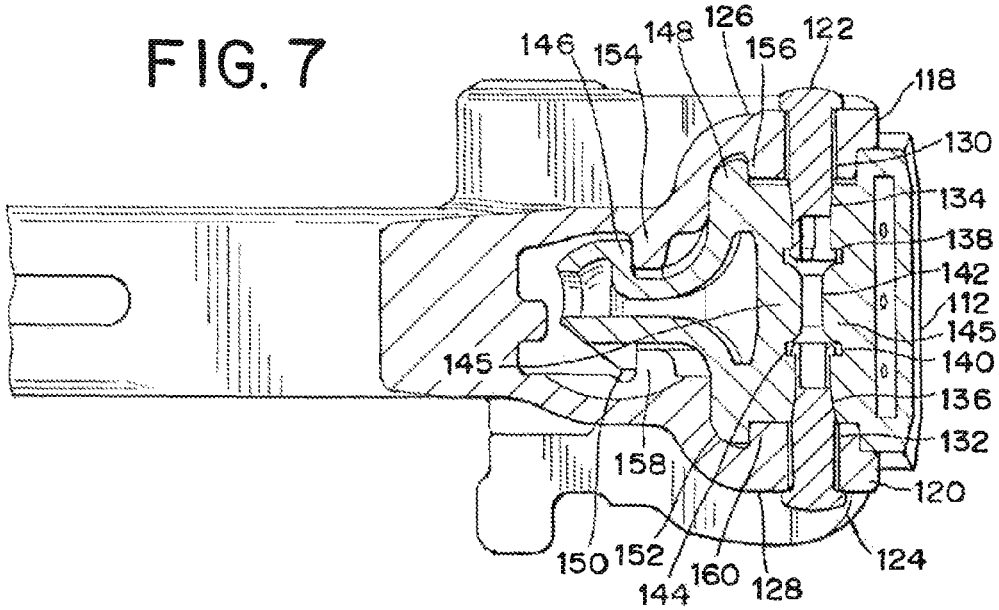
FIG. 7 is a sectional view of the coupler-knuckle assembly of the present invention along lines 7-7 of FIG. 4.

Referring now to FIGS. 1-3, an E-type coupler-knuckle assembly known in the prior art is generally designated 10 and includes a coupler body 11, a knuckle 22, and a knuckle pin 32. The coupler body 11 comprises generally a coupler head 12 and a coupler shank 14 which is adapted to be mounted on a railway car (not shown). The coupler-knuckle assembly 10 serves to transfer buff and draft loads that are exerted on the assembly 10 during use, from the knuckle 22 to the coupler body 11, without damaging knuckle pin 32.

The coupler head 12 has a knuckle side 16 and a guard arm side 18. Coupler head 12 has a front face 24 including a throat portion 26 extending towards the knuckle side 16 in a curved manner toward upper pivot lug 28 and lower pivot lug 30. Coupler head 12 includes outwardly protruding flange sections 34 and 36 from the top surface 38 of upper pivot lug 28 and the bottom surface 64 of lower pivot lug 30 respectively. Along with pulling and buffing loads on a coupler head 12 during use, a bending load is present which acts to pull upper pivot lug 28 away from lower pivot lug 30. The flange sections 34 and 36 provide the necessary strength to prevent pivot lugs 28 and 30 from bending away from each other.

The knuckle 22 is inserted between upper pivot lug 8 and lower pivot lug 30, with the upper and lower pinholes 50 and 52 in the upper and lower pivot lugs 28 and 30 respectively, aligned with pinhole 54 in knuckle 22. The knuckle 22 is pivotally secured in place by knuckle pin 32, that is inserted through pinholes 50 and 52 in the upper and lower pivot lugs respectively, and through pinhole 54 in the knuckle 22. Pinholes 50 and 52 in the upper and lower pivot lugs 28 and 30, and pinhole 54 through knuckle 22 generally have a circular cross-section that is greater than the cross-sectional area of the knuckle pin 32.

Knuckle pin 32 comprises a longitudal cylindrical member having a length greater than that of the distance between the upper and lower pivot lugs 28 and 30, allowing a bottom portion 42 of knuckle pin 32 to extend beyond lower pivot lug 30. A cotter pin 46 or other locking mechanism secures knuckle pin 32 in place in the coupler-knuckle assembly 10. The cotter pin 46 prevents knuckle pin 32 from unintentional upward removal during use, and allows knuckle pin 32 to rotate. At the end opposite the bottom portion 42, knuckle pin 32 has a head 44 which is diametrically larger than upper pinhole 50, preventing knuckle pin 32 from moving downward during use. The head 44 also allows a maintenance worker to issue downward blows on the knuckle pin 32 during installation of the knuckle pin 32 into the coupler-knuckle assembly 10 without damaging the knuckle pin 32.

As a result of buff and draft movements during use, force and stress is exerted on the top pulling lugs 60, 62 and the bottom pulling lugs 64, 66 of the knuckle 22, causing them to contact with top pulling lugs 68, 70 and bottom pulling lugs 72, 74 of the coupler body 11 respectively. While in use, when uneven force is exerted on the top and bottom pulling lugs of the coupler and knuckle, the coupler-knuckle assembly can become misaligned as the rigid single knuckle pin only allows one set (either the upper pulling lugs or the lower pulling lugs) of pulling lugs on the coupler and knuckle to contact. This places unwanted force on the coupler, knuckle, and knuckle pin. This force causes the knuckle 22 to move with respect to the coupler body 11, exerting force on knuckle pin 32, as well as the knuckle 22 and coupler body 11. The area of the knuckle 22 that experiences the most stress from the misalignment of the coupler and knuckle is the throat area 76. The throat area 76 of the knuckle 22 is the internal area of the knuckle 22 immediately surrounding the knuckle pinhole 54. The use of a single knuckle pin 32 places a load on knuckle pin 32 when the pulling lugs become misaligned, causing fatigue and damage to the coupler, knuckle, and knuckle pin.

Referring now to FIGS. 4-7, a coupler-knuckle assembly embodying the improved design of the present invention is generally designated 100 and includes a coupler body 102, a knuckle 112, and two knuckle retainer plugs 122, 124. The knuckle and knuckle retainer plug design can be used in current OEM coupler production or for field replacement when knuckles need to be replaced in current revenue service. The improved knuckle couples with any Type E, F, or H couplers.

The coupler body 102 of the present invention includes the same components and is the same design as the prior art coupler body 11 Shown in FIGS. 1-3. Thus, the coupler body 102 includes a coupler head 104 and coupler shank 106. The coupler head 104 has a knuckle side 108 and a guard arm side 110. Coupler head 104 has a front face 114 including a throat portion 116 extending towards the knuckle side 108 in a curved manner toward upper pivot lug 118 and lower pivot lug 120. All parts of coupler body 102 function the same way as described previously for prior art coupler body 11.

The knuckle 112 of the present invention contains a top tapered hole 130 and a bottom tapered hole 132 that extend into the knuckle and towards each other, but do not connect. The tapered holes 130 and 132 are symmetrical, and contain a top locking groove 138 in the top tapered hole 130 and a bottom locking groove 140 in the bottom tapered hole 132 at the bottom of each respective hole. Both locking grooves 138, 140 are identical. The locking grooves 138, 140 pivotally secure the knuckle 112 into the coupler body 102, and ensure the knuckle plugs 138, 140 remain in place during use. A hollow shaft 142 that is diametrically smaller than the tapered holes 134, 136 connects the top tapered hole 134 and the bottom tapered hole 136. The hollow shaft 142 allows the internal coring geometry 144 of knuckle 112 to have a greater cross-sectional area in the throat portion 145 of the knuckle 112. This internal coring geometry change leads to added strength and less fatigue endurance on the knuckle during use, while still making the knuckle light enough for installation purposes.

Figure 8:
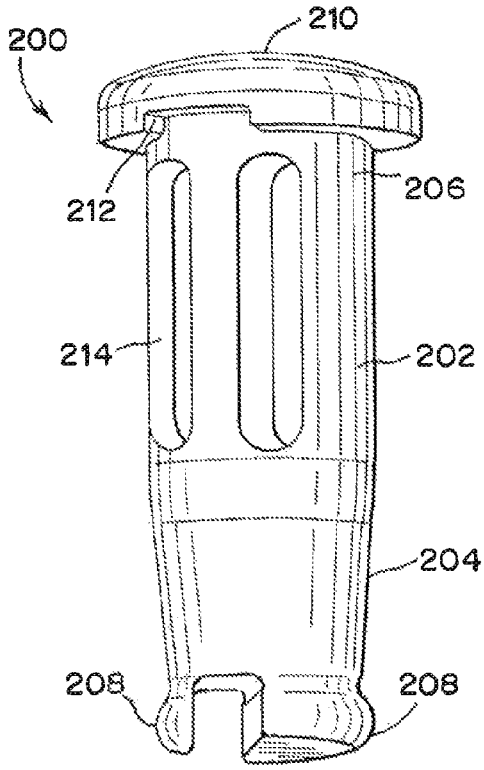
FIG. 8 is a top perspective view of the knuckle retainer plug of the present invention.
Figure 9:
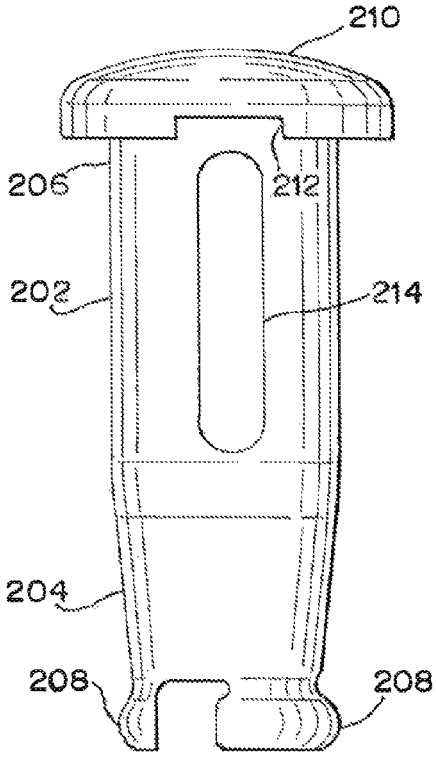
FIG. 9 is a side elevational view of the knuckle retainer plug of the present invention.
Figure 10:
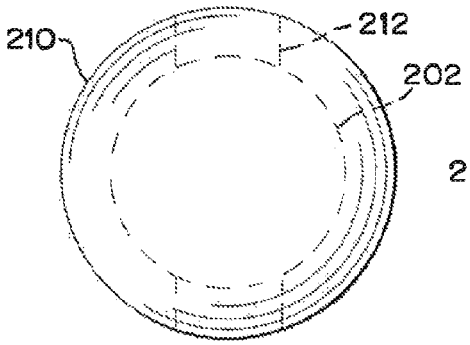
FIG. 10 is a top plan view of the knuckle retainer plug of the present invention.
Figure 11:
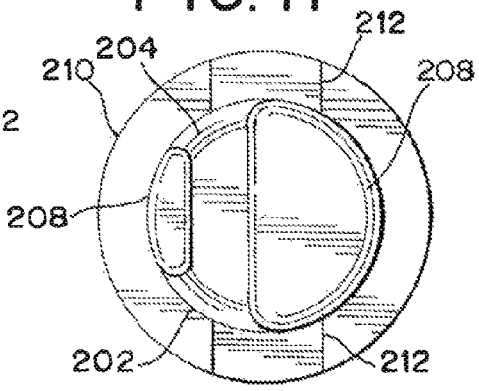
FIG. 11 is a bottom plan view of the knuckle retainer plug of the present invention.

The knuckle 112 of the present invention is inserted between upper pivot lug 118 and lower pivot lug 120 of coupler head 104, and secured into place by an upper retainer plug 122 and lower retainer plug 124. The retainer plugs 122, 124 include a longitudal member that serves to lock the knuckle 112 into the coupler body 102 and allow the knuckle 112 to pivotally move with respect to the coupler body 102. Upper retainer plug 122 is inserted through the top plug hole 130 in upper pivot lug 118 and into top tapered hole 134 of knuckle 112, and lower retainer plug 124 is inserted through bottom plug hole 132 in lower pivot lug 120 and into bottom tapered hole 136. Upper retainer plug 122 and lower retainer plug 124 are secured in place by top locking groove 138 and bottom locking groove 140 respectively. The knuckle retainer plugs 122, 124 are snapped into place by exerting pressure on the retainer plugs 122, 124 driving it into the knuckle, with the locking tab 208 (FIG. 8) of the knuckle retainer plugs 122, 124 secured into the place by the locking grooves 138, 140 in the knuckle 112.

After knuckle 112 is secured in place by upper and lower retainer plugs 122, 124, the top pulling lugs 146, 148 and the bottom pulling lugs 150, 152 of knuckle 112 are aligned with top pulling lugs 154, 156 and bottom pulling lugs 158, 160 of coupler body 102 respectively.

During use, when uneven force is exerted on the top pulling lugs of the coupler and knuckle, the coupler-knuckle assembly can become misaligned placing force on the coupler, knuckle, and knuckle pin. The inventive coupler-knuckle assembly utilizing the retainer plug design allows the retainer plugs to move independently of each other ensuring contact between both the upper pulling lugs of the knuckle and the upper pulling lugs of the coupler, and the lower pulling lugs of the knuckle and the lower pulling lugs of the coupler. Both sets of pulling lugs (upper and lower) on the coupler and knuckle remain in alignment, allowing the knuckle retainer plugs to remain unloaded during use, preventing breakage of the knuckle retainer plugs, and ensuring even load distribution during buff and draft movements.

Referring now to FIGS. 8-11, a knuckle retainer plug of the present invention designated 200 includes a shaft 202 with a bottom tapered end 204 and a top end 206. The knuckle retainer plug 200 can be made of a metallic or plastic material. The shaft 202 is a longitudal member with a circular cross-sectional area that is smaller than that of the plug holes 130, 132 in the pivot lugs 118, 120. On the bottom tapered end 204 there are locking tabs 208 that allow the knuckle retainer plug 200 to lock into the locking grooves 138, 140 of knuckle 112. The locking tabs 208 ensure that the knuckle is securely attached to the coupler body in the open, closed, or rotated positions, while still allowing the knuckle to rotate. On the top end 206 of the shaft 202 is a head 210. The head 210 is dome-shaped and generally has a circular cross-sectional shape having a cross-sectional area greater than that of the shaft 202 and the plug holes 130, 132 in the pivot lugs 118, 120. It is also contemplated that the present invention can have a head 210 that is a non-circular shape. The head 210 includes at least one relief or cutout 212 that allows a person to easily remove the knuckle retainer plug 200 with a pry bar, standard slotted screwdriver, or any other shaft-like tool. To remove the knuckle retainer plug from the coupler, the tip of the removal tool is inserted into the relief area beneath the head of the knuckle plug, and the removal tool is forced against the coupler body forcing the plug to unsnap from the locking groove in the knuckle. The removed knuckle retainer plug can be reused and reinserted into another coupler-knuckle assembly. The shaft 202 of the knuckle retainer plug 200 also contains relief areas 214. These relief areas 214 allow the shaft to use less material in the molding process and allow the knuckle retainer plug 200 to cool faster after the molding process is complete.

While particular embodiments of the present knuckle pin have been described herein, it will be appreciated by those skilled in the art that changes and modifications may be made thereto without departing from the invention in its broader aspects.

What is claimed is:

1. An improved railway coupler-knuckle assembly of metal composition comprising:

a coupler body including a plurality of pinholes;

a knuckle including a plurality of pinholes;

a plurality of knuckle retainer plugs;

wherein said knuckle is secured into said coupler body by aligning said plurality of pinholes in said coupler body with said plurality of pinholes in said knuckle, inserting said plurality of knuckle retainer plugs through said plurality of pinholes in said coupler body and into said plurality of pinholes in said knuckle, wherein said plurality of pinholes in said knuckle are tapered.

2. The improved railway coupler-knuckle assembly of metal composition of claim 1, wherein said plurality of pinholes in said coupler body includes a top coupler pinhole and a bottom coupler pinhole, said plurality of pinholes in said knuckle includes a top knuckle pinhole and a bottom knuckle pinhole, and said plurality of knuckle retainer plugs includes a top knuckle retainer plug and a bottom retainer plug.

3. The improved railway coupler-knuckle assembly of metal composition of claim 2, wherein said knuckle is secured into said coupler body by inserting said top knuckle retainer plug through said top coupler pinhole into said top knuckle pinhole, and inserting said bottom knuckle retainer plug through said bottom coupler pinhole and into said bottom knuckle pinhole.

4. The improved railway coupler-knuckle assembly of metal composition of claim 1, wherein each of said. plurality of knuckle retainer plugs has a longitudal shaft including a tapered bottom end and a top end.

5. The improved railway coupler-knuckle assembly of metal composition of claim 4, wherein each said plurality of knuckle retainer plugs includes a locking mechanism on said tapered bottom end.

6. The improved railway coupler-knuckle assembly of metal composition of claim 4, wherein each said plurality of knuckle retainer plugs includes a head on said top end of said shaft, with at least one relief area in said head.

7. The improved railway coupler-knuckle assembly of metal composition of claim 1, wherein said plurality of pinholes in said knuckle have a bottom surface including a locking groove on said bottom surface.

8. The improved railway coupler-knuckle assembly of metal composition of claim 1, wherein said bottom surface of said plurality of pinholes is connected by a hollow shaft.

* * * * *